US010072434B1

(12) United States Patent
Liu et al.

(10) Patent No.: US 10,072,434 B1
(45) Date of Patent: Sep. 11, 2018

(54) WAVE-DISSIPATING FLOAT FOR SWIMMING POOL LANE ROPE

(71) Applicant: SIBAUD SPORTS AND LEISURE DEVELOPMENT CO., LTD., Chiayi County (TW)

(72) Inventors: Yen-Chen Liu, Chiayi County (TW); Yi-Cheng Tung, Taichung (TW); Chih-Wei Ma, Nantou County (TW); Guan-Ting Wu, Chiayi (TW); Yan-Yu Lin, Chiayi County (TW)

(73) Assignee: Sibaud Sports and Leisure Development Co., Ltd., Chiayi County (TW)

( * ) Notice: Subject to any disclaimer, the term of this patent is extended or adjusted under 35 U.S.C. 154(b) by 0 days.

(21) Appl. No.: 15/646,166

(22) Filed: Jul. 11, 2017

(51) Int. Cl.
*E04H 4/14* (2006.01)

(52) U.S. Cl.
CPC ..... *E04H 4/143* (2013.01)

(58) Field of Classification Search
CPC .... E04H 4/143; F16L 1/24; F16L 1/14; B63B 22/00; B63B 22/02
USPC ..... 441/133; 4/497
See application file for complete search history.

(56) References Cited

U.S. PATENT DOCUMENTS 3,540,063 A * 11/1970 Stanwood ..... E04H 4/14 4/497
3,755,829 A * 9/1973 Walklet ..... E04H 4/143 4/497
3,757,370 A * 9/1973 Seno ..... E04H 4/143 4/497
3,886,602 A * 6/1975 Stanwood ..... E04H 4/143 4/497
4,048,677 A * 9/1977 Kajlich ..... E04H 4/143 4/497
4,052,755 A * 10/1977 Baker ..... E04H 4/143 4/497
4,616,369 A * 10/1986 Rademacher ..... E04H 4/143 4/497
4,894,873 A * 1/1990 Kiefer ..... E04H 4/143 4/497
5,330,378 A * 7/1994 Park ..... B63B 21/20 114/267
5,520,562 A * 5/1996 Eddy ..... E04H 4/143 4/497
5,558,459 A * 9/1996 Odenbach ..... E02B 3/062 405/21

(Continued)

FOREIGN PATENT DOCUMENTS

CN 2514065 Y * 10/2002

*Primary Examiner* — Lars A Olson
*Assistant Examiner* — Jovon E Hayes
(74) *Attorney, Agent, or Firm* — Rosenberg, Klein & Lee

(57) ABSTRACT

A wave-dissipating float for a swimming pool lane rope includes a cylindrical body composed of a first casing and a second casing. The cylindrical body is provided with a fixing hole and at least one perforation. For installation, it is not necessary to disassemble one end of the swimming pool lane rope. The rope of the lane rope is placed in a first semicircular fixing hole of the first casing and a second semicircular fixing hole of the second casing, and then the first casing and the second casing are coupled to each other so that the rope of the lane rope is surrounded by the cylindrical body to complete the assembly.

9 Claims, 7 Drawing Sheets

(56) References Cited

U.S. PATENT DOCUMENTS

| | | | | |
|---|---|---|---|---|
| 6,331,129 | B1 * | 12/2001 | Earley | E04H 4/143<br>441/133 |
| 8,647,014 | B2 * | 2/2014 | McCormick | E02B 3/062<br>405/27 |
| 2004/0031093 | A1 * | 2/2004 | Kajlich | E04H 4/143<br>4/497 |
| 2014/0024501 | A1 * | 1/2014 | Tabena Isern | A63B 35/00<br>482/55 |
| 2016/0348809 | A1 * | 12/2016 | Elder | F16L 1/24 |

* cited by examiner

WAVE-DISSIPATING FLOAT FOR SWIMMING POOL LANE ROPE

FIELD OF THE INVENTION

The present invention relates to a wave-dissipating float for a swimming pool lane rope, and more particularly to a wave-dissipating float composed of two coupled casings.

BACKGROUND OF THE INVENTION

Chinese Utility Model Publication No. CN2514065 relates to a wave-dissipating float for a swimming pool lane rope. The wave-dissipating float is integrally made of a plastic foam material by molding. The outer edge of the wave-dissipating float is provided with a predetermined number of wave-dissipating grooves. The wave-dissipating float has a perforation formed therein. The perforation is an elongate perforation extending along a lengthwise direction of the wave-dissipating float. The wave-dissipating float integrally made of a plastic foam material by molding provides a good touch with the human body, and will not scratch the human body, can provide a high degree of safety to swimmers, and can be rolled up, disassembled and assembled easily and quickly.

The above-mentioned wave-dissipating float can be used to divide the lanes of the swimming pool and able to dissipate the waves caused by the swimmers, but the installation of a lane rope is troublesome because the wave-dissipating float is integrally formed by molding. When installed, one end of a rope is inserted through the perforations of multiple wave-dissipating floats one by one to form a lane rope, and then both ends of the lane rope are fixed to the side of the swimming pool with buckles. Because the lane rope is immersed in the low-acid or low-alkali water containing bleach of the swimming pool for a long-term, and exposed to the sun and hit by swimmers, some of the wave-dissipating floats of the lane rope may be damaged. Once a wave-dissipating float needs replacing, it is necessary to remove one end of the lane rope first, and then remove the undamaged wave-dissipating floats one by one until the damaged wave-dissipating float is removed. Finally, a new one and the undamaged wave-dissipating floats are mounted to the rope one by one again to complete the replacement. This way is quite troublesome. In particular, the end of the rope may be deformed and forked subjected to the buckle, so it is difficult for the rope to be reinserted through the wave-dissipating floats. Therefore, the lane rope of the swimming pool is often repaired until a number of wave-dissipating floats are damaged in order to save time and cost. As a result, swimmers are accidentally scratched by the damaged wave-dissipating floats, increasing the risk of sports environment. Accordingly, the inventor of the present invention has devoted himself based on his many years of practical experiences to solve these problems.

SUMMARY OF THE INVENTION

In view of the shortcomings of the prior art, the primary object of the present invention is to provide a wave-dissipating float for a swimming pool lane rope. The wave-dissipating float comprises a cylindrical body and at least one perforation. The cylindrical body includes a first casing and a second casing. The first casing is provided with at least one first coupling unit. The second casing is provided with at least one second coupling unit. The first coupling unit and the second coupling unit are coupled to each other for connecting the first casing with the second casing to form the cylindrical body. The cylindrical body has a fixing hole penetrating the cylindrical body. The at least one perforation is disposed on the cylindrical body.

Preferably, the cylindrical body has a side portion and opposing two end portions. Two ends of the side portion are connected to the end portions, respectively. The at least one perforation includes a wave-dissipating hole and a wave discharge groove. The wave-dissipating hole is disposed on the side portion. The wave discharge groove is disposed on the end portions.

Preferably, the first casing and the second casing are respectively provided with opposing two first semicircular fixing holes and two second semicircular fixing holes for jointly defining the fixing hole and penetrating the two end portions.

Preferably, the wave-dissipating hole has a circular or polygonal shape. The wave discharge groove has an elliptical or elongate shape radially arranged along the respective end portions.

Preferably, an outer surface of the side portion is axially provided with at least one rib.

Preferably, the first coupling unit includes a first engaging member and a first engaging groove. The second coupling unit includes a second engaging member and a second engaging groove. The first engaging member is engaged with the second engaging groove and the second engaging member is engaged with the first engaging groove for connecting the first casing with the second casing.

Preferably, the first coupling unit includes a first protrusion and a first recess. The second coupling unit includes a second protrusion and a second recess. The first protrusion is engaged with the second recess and the second protrusion is engaged with the first recess for connecting the first casing with the second casing.

Preferably, the first coupling unit is disposed at an edge of the first casing, and the second coupling unit is disposed at an edge of the second casing.

Preferably, an outside of the cylindrical body is provided with at least one disengaging portion. The disengaging portion corresponds to the first coupling unit and the second coupling unit after assembled for applying an external force to break the first coupling unit and the second coupling unit quickly.

Preferably, the disengaging portion is a depression.

According to the above technical features, the present invention can achieve the following effects:

1. The cylindrical body is composed of the first casing and the second casing which are coupled to each other. When installed, the rope of the lane rope is placed in the first semicircular fixing holes and the second semicircular fixing holes, and then the first coupling unit and the second coupling unit are coupled together so that the rope is located in the fixing hole and surrounded by the cylindrical body. In this way, a plurality of cylindrical bodies are disposed on the rope to complete the assembly of the lane rope, improving the shortcomings of the conventional floats to be inserted one by one from one end of the rope A1.

2. When the water of the swimming pool has waves created by swimmers, the waves will impact the ribs of the cylindrical bodies from both sides of the lane rope, the cylindrical bodies are rotated with the rope of the lane rope as an axis to weaken the force of the waves. The ribs of the cylindrical body serve as a support to prevent the cylindrical body from being deformed and damaged by the external force.

3. When the waves pass through the wave-dissipating holes from both sides of the cylindrical body, the waves are branched and dispersed. The waves in the cylindrical body are blocked by the side portion or impacted by the waves at both sides to flow out from the wave discharge grooves at the two ends of the cylindrical body. The waves are guided from a radial flow into an axial flow to eliminate the fluctuations of the swimming pool, to reduce the ups and downs of the water, to avoid other swimmers from being influenced by the waves, to prevent the water from being too turbulent, and to protect the safety of swimmers.

4. In order to prevent the cylindrical body from being hit by the swimmers to disengage from the rope of the lane rope, the first coupling unit and the second coupling unit cannot be separated once they are coupled. When the cylindrical body is to be replaced, it is necessary to use a tool to break the cylindrical body by applying an external force. The tool is placed on the disengaging portion, and the concave configuration of the disengaging portion allows the drill bit of the tool to be stably inserted. The disengaging portions are disposed on the ribs corresponding to the first coupling unit and the second coupling unit after assembled. Therefore, the tool is able to rapidly break the first coupling unit and the second coupling unit from the disengaging portions, so that the first casing of the cylindrical body is disengaged from the second casing in order to complete the replacement.

The cylindrical body is made of high-density polyethylene (HDPE) which is resistant to corrosion and radiation, without adding any recycled plastics, rock flour, so it is more safe and durable for use.

DETAILED DESCRIPTION OF THE PREFERRED EMBODIMENTS

Embodiments of the present invention will now be described, by way of example only, with reference to the accompanying drawings.

Figure 1:
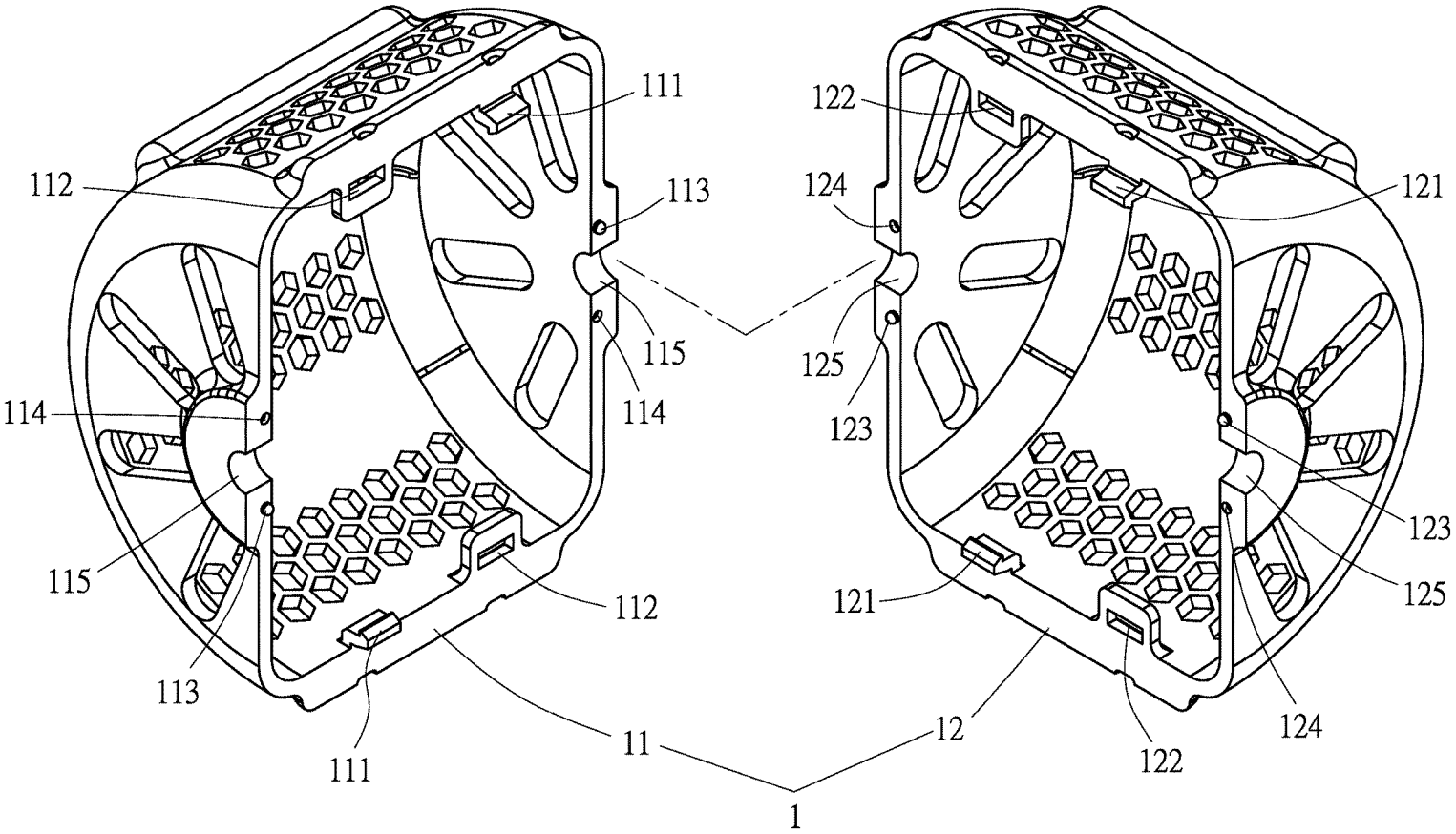
FIG. 1 is an exploded view in accordance with a first embodiment of the present invention.
Figure 2:
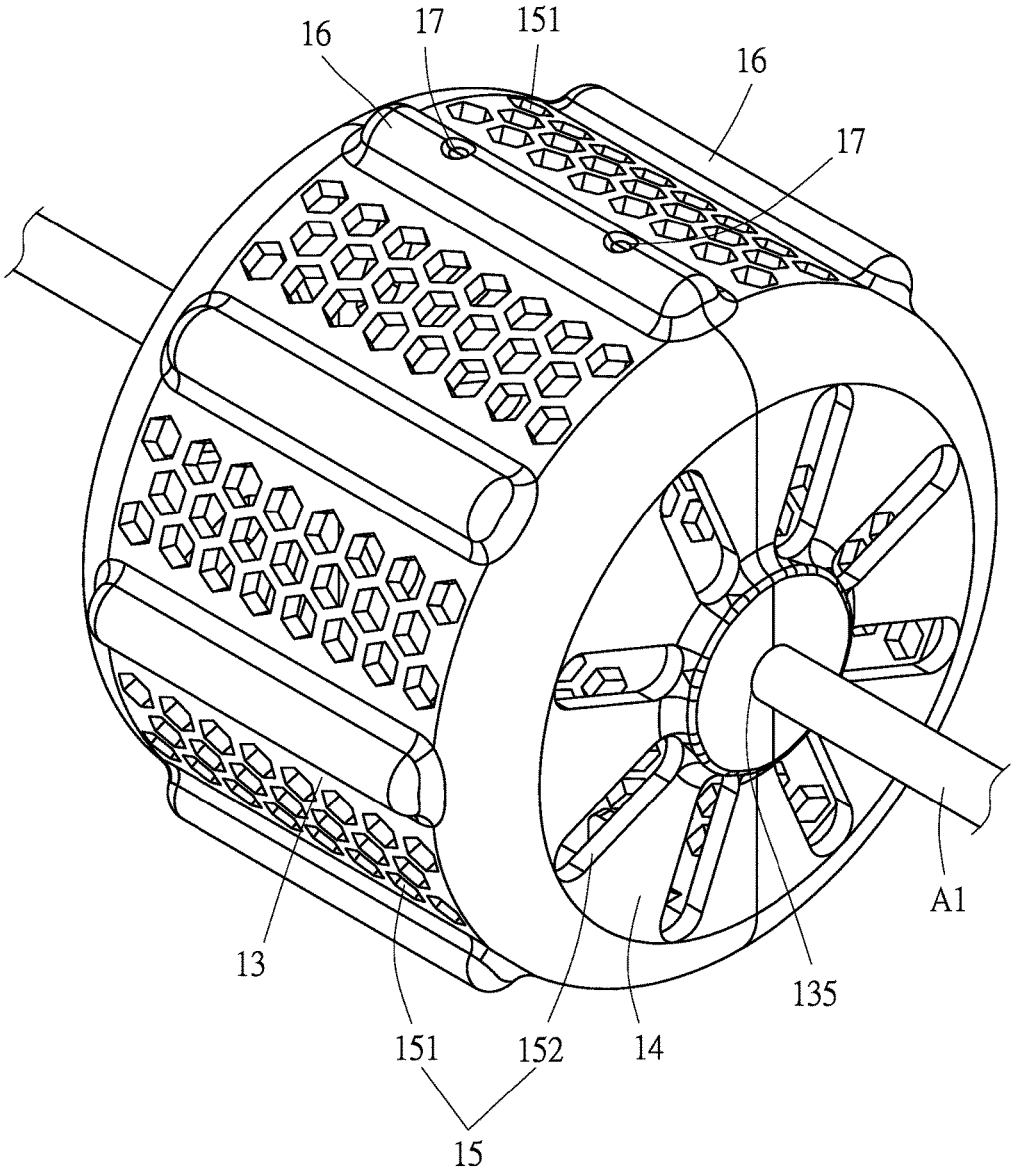
FIG. 2 is a perspective view in accordance with the first embodiment of the present invention.

As shown in FIG. 1 and FIG. 2, a wave-dissipating float for a swimming pool lane rope according to a first embodiment of the present invention comprises a cylindrical body (1) and a plurality of perforations (15) disposed on the cylindrical body (1).

In this embodiment, the cylindrical body (1) is made of high-density polyethylene (HDPE) which is resistant to corrosion and radiation. The cylindrical body (1) comprises a first casing (11) and a second casing (12). The first casing (11) is provided with a first coupling unit. The first coupling unit is disposed at an edge of the first casing (11). The first coupling unit of this embodiment includes two first engaging members (111), two first engaging grooves (112), two first protrusions (113), and two first recesses (114). The second casing (12) is provided with a second coupling unit. The second coupling unit is disposed at an edge of the second casing (12). The second coupling unit of this embodiment includes two second engaging members (121), two second engaging grooves (122), two second protrusions (123), and two second recesses (124). The first engaging members (111) are engaged with the second engaging grooves (122), respectively. The second engaging members (121) are engaged with the first engaging grooves (112), respectively. The first protrusions (113) are engaged with the second recesses (124), respectively. The second protrusions (123) are engaged with the first recesses (114), respectively. Thereby, the first casing (11) and the second casing (12) are connected together to form the cylindrical body (1). The first casing (11) and the second casing (12) are provided with opposing two first semicircular fixing holes (115) and two second semicircular fixing holes (125), respectively. The first semicircular fixing holes (115) and the second semicircular fixing holes (125) jointly define fixing holes (135) when the first casing (11) and the second casing (12) are connected together. After assembled, the cylindrical body (1) has a side portion (13) and opposing two end portions (14). Two ends of the side portion (13) are connected to the end portions (14), respectively. The fixing holes (135) penetrate through the end portions (14), respectively.

The perforations (15) include wave-dissipating holes (151) and wave discharge grooves (152). The wave-dissipating holes (151) are disposed on the side portion (13). The wave discharge grooves (152) are disposed on the end portions (14). The wave-dissipating holes (151) each have a hexagonal shape in this embodiment, but not limited thereto. The wave-dissipating holes (151) may have a circular or polygonal shape. The wave discharge grooves (152) each have an elliptical shape, but not limited thereto, and they may have an elongate shape. The wave discharge grooves (152) are radially arranged along the respective end portions (14). A plurality of ribs (16) is provided on an outer surface of the side portion (13). The wave-dissipating holes (151) are evenly distributed between every two of the ribs (16). A plurality of disengaging portions (17) is provided on the cylindrical body (1). The disengaging portions (17) are depressions formed on opposing two of the ribs (16) at the outside of the cylindrical body (1). The disengaging portions (17) are located on the ribs (16) corresponding to the first coupling unit and the second coupling unit after assembled.

Figure 3:
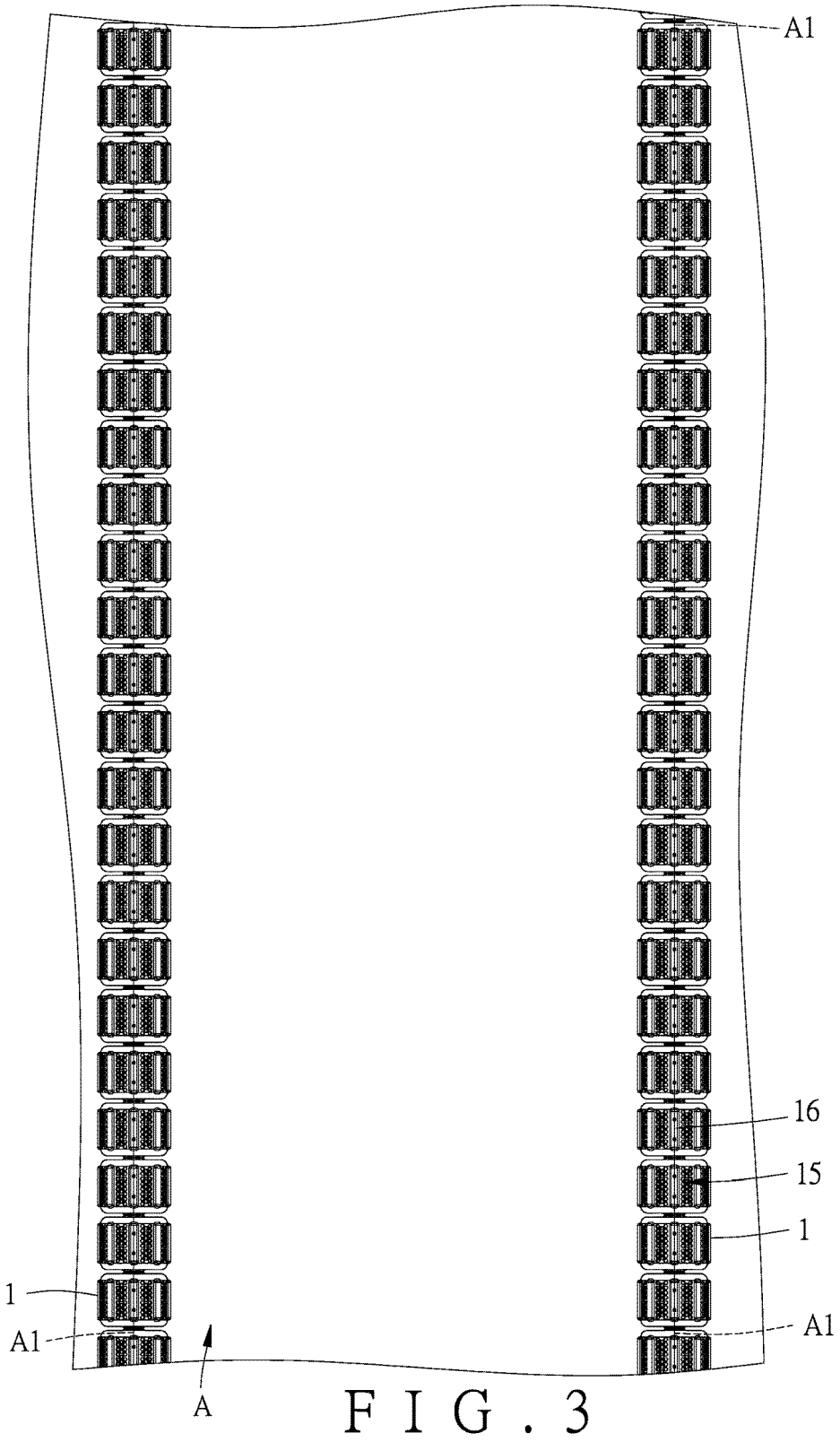
FIG. 3 is a schematic view in accordance with the first embodiment of the present invention when in use.

Referring to FIG. 1 and FIG. 3, the first semicircular fixing holes (115) and the second semicircular fixing holes (125) are aligned with and correspond to a rope (A1) of a lane rope a swimming pool (A), respectively. In this embodiment, the rope (A1) is a rope formed of high-performance polyethylene fibers by knitting, which is resistant to corrosion and radiation, but not limited thereto. The rope (A1) of the lane rope may be a cable. By connecting the first coupling unit with the second coupling unit, the first engaging members (111) are engaged with the second engaging grooves (122) respectively; the second engaging members (121) are engaged with the first engaging grooves (112) respectively; the first protrusions (113) are engaged with the second recesses (124) respectively; and the second protrusions (123) are engaged with the first recesses (114) respectively, such that the rope (A1) of the lane rope is inserted through the cylindrical body (1) and is located in the fixing holes (135) and surrounded by the cylindrical body (1). In this way, a plurality of cylindrical bodies (1) is provided on the rope (A1) of the lane rope to quickly complete the assembly of the lane rope, improving the shortcomings of the conventional floats to be inserted one by one from one end of the rope (A1) of the lane rope. The cylindrical bodies (1) on the rope (A1) of the lane rope can be used to divide the lanes of the swimming pool (A), and the waves of the swimming pool (A) can be absorbed through the perforations (15) and the ribs (16) of the cylindrical bodies (1).

Figure 4:
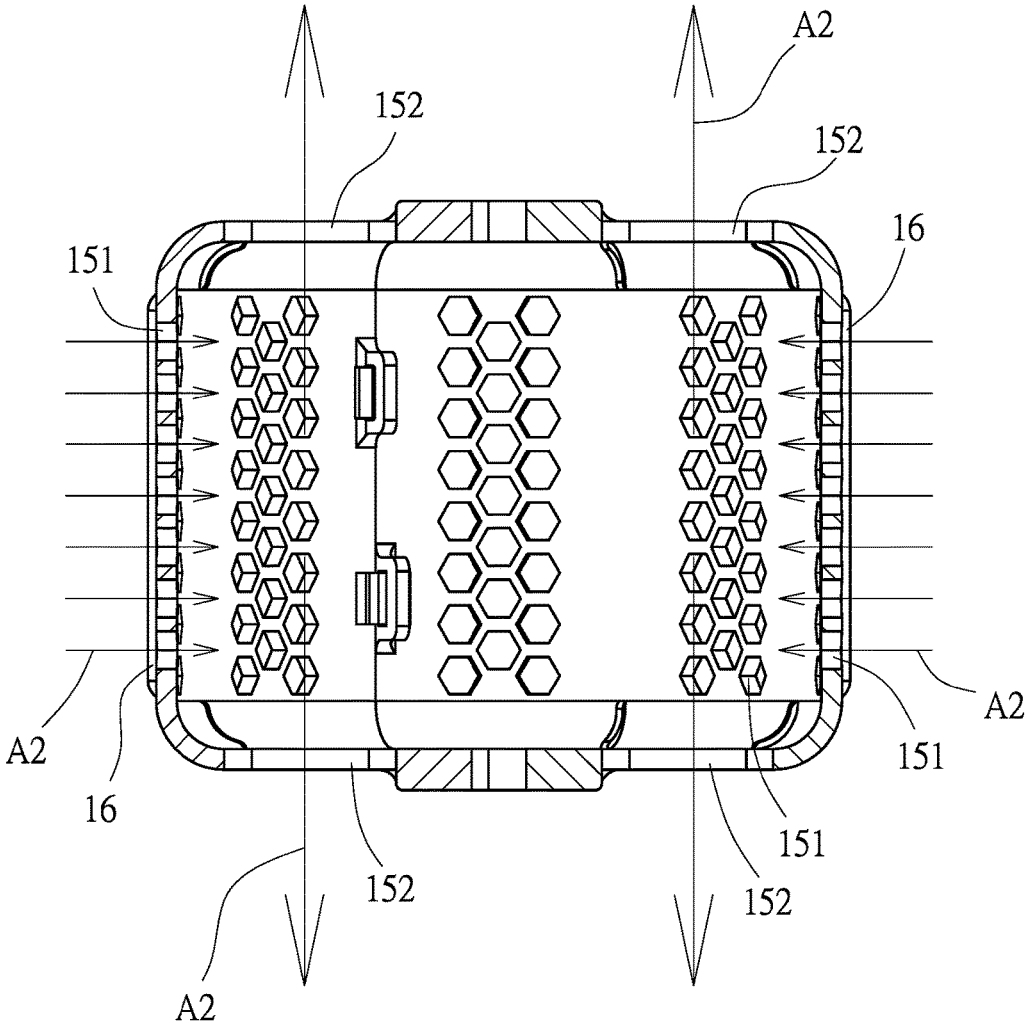
FIG. 4 is a schematic view in accordance with the first embodiment of the present invention, showing that the waves are branched and dispersed.

As shown in FIG. 4, when the water of the swimming pool (A) has waves (A2) created by swimmers, the waves (A2) will impact the ribs (16) of the cylindrical bodies (1) from both sides of the lane rope, the cylindrical bodies (1) are rotated with the rope (A1) of the lane rope as an axis to weaken the force of the waves (A2). The ribs (16) of the cylindrical body (1) serve as a support to prevent the cylindrical body (1) from being deformed and damaged by the external force. When the waves (A2) pass through the wave-dissipating holes (151) from both sides of the cylindrical body (1), the waves (A2) are branched and dispersed. The waves (A2) in the cylindrical body (1) are blocked by the side portion (13) or impacted by the waves (A2) at both sides to flow out from the wave discharge grooves (152) at the two ends of the cylindrical body (1). The waves (A2) are guided from a radial flow into an axial flow to eliminate the fluctuations of the swimming pool (A), to reduce the ups and downs of the water, to avoid other swimmers from being influenced by the waves, to prevent the water from being too turbulent, and to protect the safety of swimmers.

Figure 5:
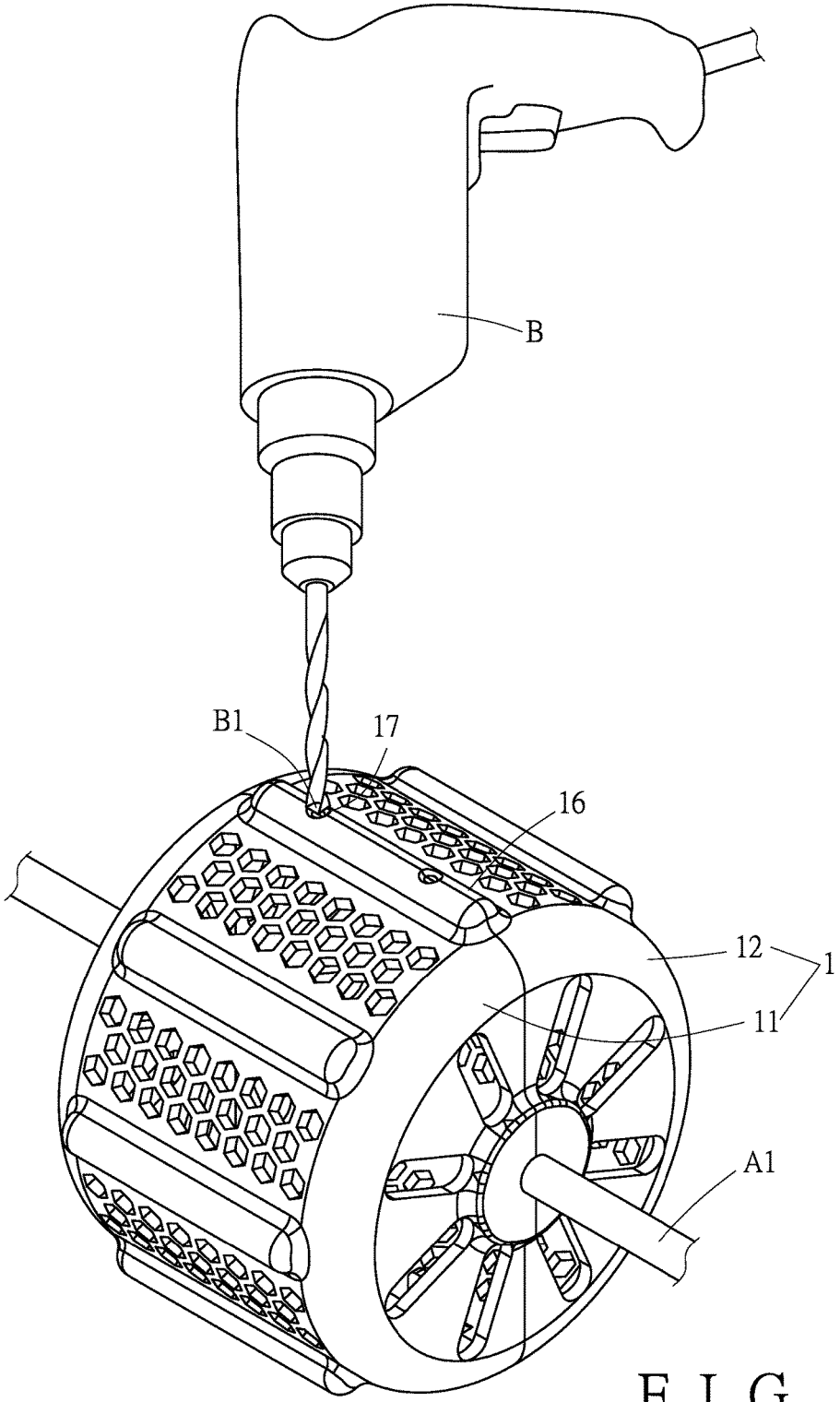
FIG. 5 is a schematic view in accordance with the first embodiment of the present invention, showing that the cylindrical body is replaced.

Referring to FIG. 5, when the cylindrical body (1) is damaged, it is necessary to use a tool to break the cylindrical body (1) by applying an external force. In order to prevent the cylindrical body (1) from being hit by the swimmers to disengage from the rope (A1) of the lane rope, the first coupling unit and the second coupling unit cannot be separated once they are coupled. When the cylindrical body (1) needs to be replaced, it is necessary to use a tool to break the cylindrical body (1) by applying an external force. In this embodiment, an electric drill (B) is used to break the cylindrical body (1). A drill bit (B1) of the electric drill (B) is placed on the disengaging portion (17), and the concave configuration of the disengaging portion (17) allows the drill bit (B1) to be stably inserted. The disengaging portions (17) are disposed on the ribs (16) corresponding to the first coupling unit and the second coupling unit after assembled. Therefore, the electric drill (B) is able to rapidly break the first coupling unit and the second coupling unit from the disengaging portions (17), so that the first casing (11) of the cylindrical body (1) is disengaged from the second casing (12) in order to complete the replacement.

Figure 6:
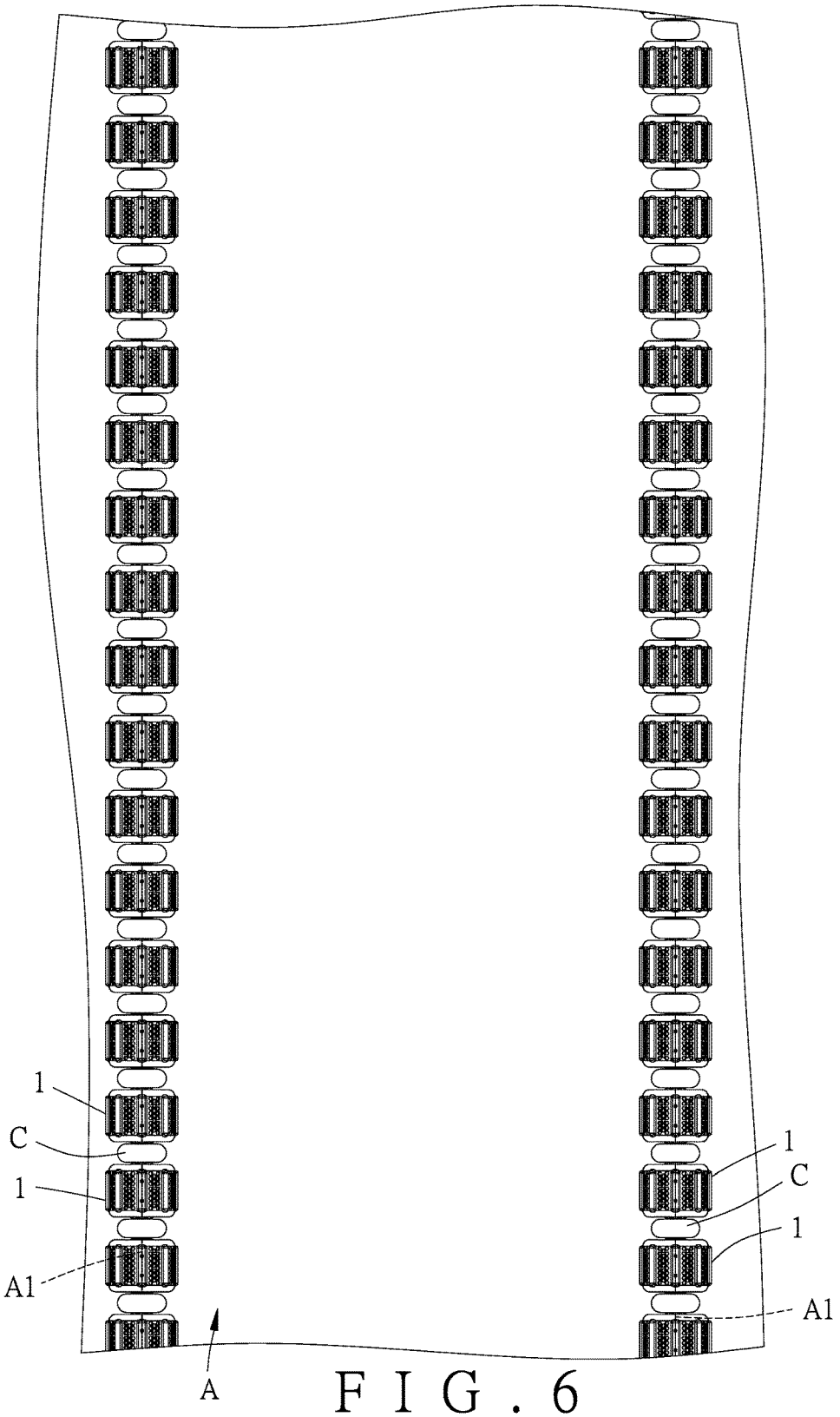
FIG. 6 is a schematic view of another assembly way of the present invention when in use.

FIG. 6 illustrates another assembly way of the present invention. A float (C) is provided between every two of the cylindrical bodies (1) on the rope (A1) of the lane rope to increase the buoyancy of the lane rope. A gap is created between every two of the cylindrical bodies (1) through the float (C), so that the user can wind the rope (A1) of the lane rope to complete the storage for cleaning the swimming pool (A) or widening the lanes of the swimming pool (A).

Figure 7:
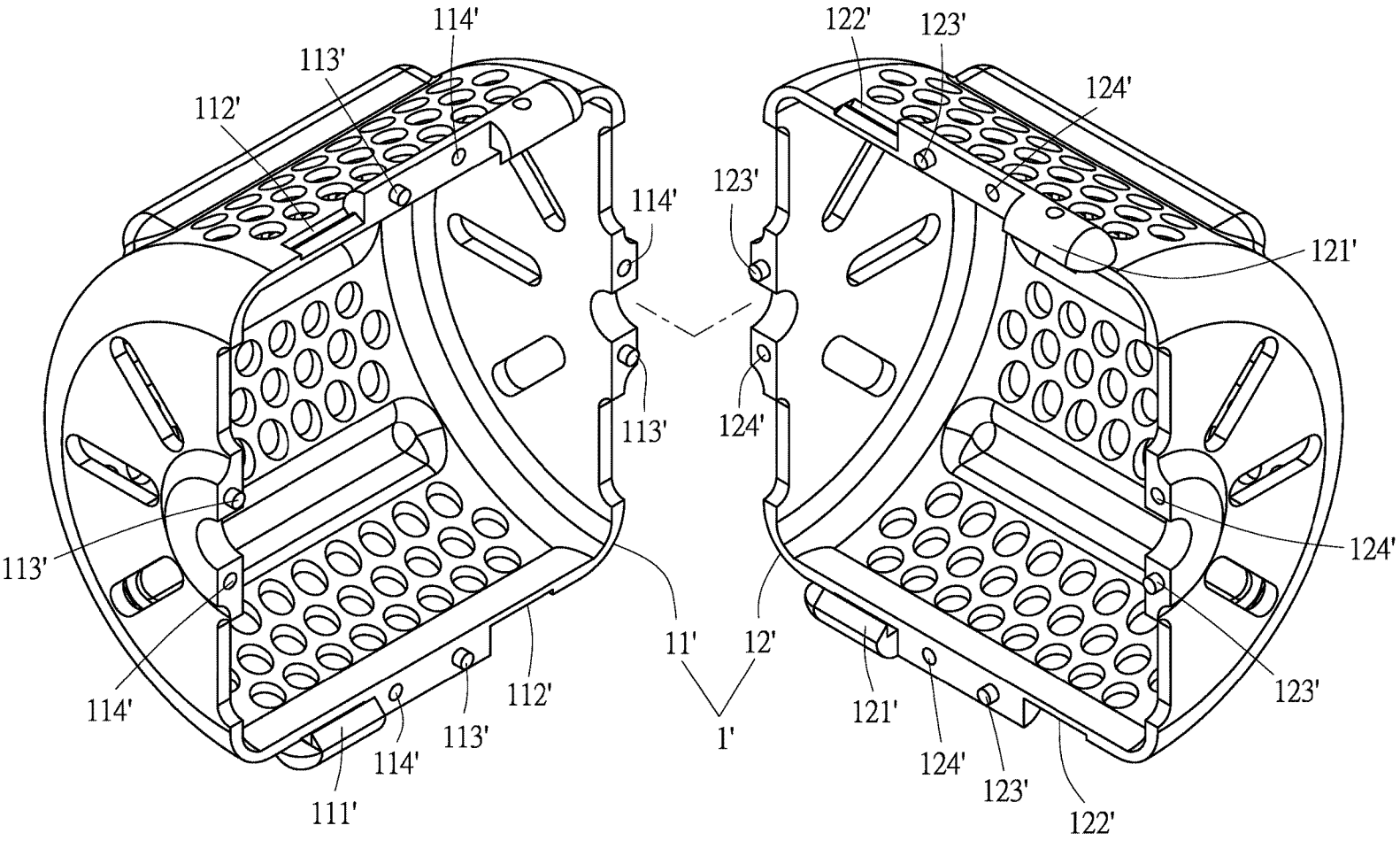
FIG. 7 is an exploded view in accordance with a first embodiment of the present invention.

FIG. 7 illustrates a second embodiment of the present invention. The second embodiment is substantially similar to the first embodiment with the exceptions described hereinafter. A cylindrical body (1') comprises a first casing (11') and a second casing (12'). The first casing (11') is provided with a first coupling unit. The first coupling unit is disposed at an edge of the first casing (11'). The first coupling unit of this embodiment includes two first engaging members (111'), two first engaging grooves (112'), four first protrusions (113'), and four first recesses (114'). The second casing (12') is provided with a second coupling unit. The second coupling unit is disposed at an edge of the second casing (12'). The second coupling unit of this embodiment includes two second engaging members (121'), two second engaging grooves (122'), four second protrusions (123'), and four 'second recesses (124). In this embodiment, any of the first engaging members (111') is close to one of the first recesses (114'), the first recess (114') is adjacent to one of the first protrusions (113'), and the first protrusion (113') is close to one of the first engaging grooves (112'), that is, the first recess (114') and the first protrusion (113') are located between the first engaging member (111') and the first engaging groove (112'). Any of the second engaging members (121') is close to one of the second recesses (124'), the second recess (124') is close to one of the second protrusions (123'), and the second protrusion (123') is close to one of the second engaging grooves (122'), that is, the second recess (124') and the second protrusion (123') are located between the second engaging member (121') and the second engaging groove (122').

The first engaging members (111') are engaged with the second engaging grooves (122'), respectively. The second engaging members (121') are engaged with the first engaging grooves (112'), respectively. The first protrusions (113') are engaged with the second recesses (124'), respectively. The second protrusions (123') are engaged with the first recesses (114'), respectively. Thereby, the first casing (11') and the second casing (12') are connected together to form the cylindrical body (1').

Although particular embodiments of the present invention have been described in detail for purposes of illustration, various modifications and enhancements may be made without departing from the spirit and scope of the present invention. Accordingly, the present invention is not to be limited except as by the appended claims.

What is claimed is:

1. A wave-dissipating float for a swimming pool lane rope, comprising:

a cylindrical body including a first casing and a second casing, the first casing provided with at least one first coupling unit, the second casing provided with at least one second coupling unit, the first coupling unit and the second coupling unit being coupled to each other for connecting the first casing and the second casing to form the cylindrical body, and at least two fixing holes penetrating the cylindrical body; and at least one perforation formed on the cylindrical body;

wherein the cylindrical body has a side portion and two opposing end portions, two ends of the side portion being connected to the two opposing end portions respectively, the at least one perforation including a wave-dissipating hole and a wave-discharge groove, the wave-dissipating hole being formed on the side portion, and the wave-discharge groove being formed on the two opposing end portions.

2. The wave-dissipating float as claimed in claim 1, wherein the first casing and the second casing are respectively provided with opposing two first semicircular fixing holes and opposing two second semicircular fixing holes for jointly defining the fixing holes and penetrating the two opposing end portions.

3. The wave-dissipating float as claimed in claim 1, wherein the wave-dissipating hole has a circular or a polygonal shape, and the wave-discharge groove has a radially-extending elliptical or elongate shape and arranged at the opposing end portions.

4. The wave-dissipating float as claimed in claim 1, wherein an outer surface of the side portion has formed thereon at least one rib extending in an axial direction.

5. The wave-dissipating float as claimed in claim 1, wherein the first coupling unit includes a first engaging member and a first engaging groove, the second coupling unit includes a second engaging member and a second engaging groove, the first engaging member is engaged with the second engaging groove and the second engaging member is engaged with the first engaging groove for connecting the first casing and the second casing.

6. The wave-dissipating float as claimed in claim 5, wherein the first coupling unit includes a first protrusion and a first recess, the second coupling unit includes a second protrusion and a second recess, the first protrusion is engaged with the second recess and the second protrusion is engaged with the first recess for connecting the first casing and the second casing.

7. The wave-dissipating float as claimed in claim 1, wherein the first coupling unit is disposed at an edge of the first casing, and the second coupling unit is disposed at an edge of the second casing.

8. The wave-dissipating float as claimed in claim 1, wherein an outer surface of the side portion of the cylindrical body has formed thereon at least one disengaging portion, and the disengaging portion corresponds in position to the first coupling unit and the second coupling unit subsequent to the first and second casings being assembled for application of an external force to the disengaging portion to disengage the first coupling unit and the second coupling unit.

9. The wave-dissipating float as claimed in claim 8, wherein the disengaging portion is a depression.

* * * * *